US008070134B1

(12) United States Patent
Bellantoni

(10) Patent No.: US 8,070,134 B1
(45) Date of Patent: Dec. 6, 2011

(54) STABILIZED SINGLE-MOTOR LIFT SYSTEM WITHOUT TOP RAILS

(76) Inventor: John F. Bellantoni, Sarasota, FL (US)

( * ) Notice: Subject to any disclaimer, the term of this patent is extended or adjusted under 35 U.S.C. 154(b) by 0 days.

(21) Appl. No.: 13/040,865

(22) Filed: Mar. 4, 2011

(51) Int. Cl.
*B66D 1/36* (2006.01)

(52) U.S. Cl. ..... 254/337; 254/336; 254/284

(58) Field of Classification Search ..... 254/278, 254/283, 284, 285, 286, 336, 337, 338
See application file for complete search history.

(56) References Cited

U.S. PATENT DOCUMENTS

| | | | | |
|---|---|---|---|---|
| 3,801,070 | A * | 4/1974 | Piasecki | 254/285 |
| 4,401,335 | A * | 8/1983 | Godbersen | 187/266 |
| 5,090,841 | A | 2/1992 | Penick, Jr. et al. | |
| 5,427,471 | A | 6/1995 | Godbersen | |
| 5,769,568 | A | 6/1998 | Parkins et al. | |
| 5,772,360 | A | 6/1998 | Wood, II | |
| 5,957,623 | A | 9/1999 | Sargent et al. | |
| 6,230,639 | B1 | 5/2001 | McLaughlin et al. | |
| 6,408,776 | B1 | 6/2002 | McLaughlin et al. | |
| 6,470,816 | B1 | 10/2002 | Golden et al. | |
| 6,484,655 | B1 | 11/2002 | Gibson | |
| 6,640,736 | B1 | 11/2003 | McLaughlin et al. | |
| 7,070,171 | B2 | 7/2006 | Mangin | |
| 7,117,805 | B2 | 10/2006 | Shackelford, Jr. | |
| 7,383,781 | B1 | 6/2008 | Griffin | |
| 7,407,150 | B1 | 8/2008 | Bellantoni | |
| 7,607,644 | B1 | 10/2009 | Gibb et al. | |

* cited by examiner

*Primary Examiner* — Emmanuel M Marcelo
(74) *Attorney, Agent, or Firm* — Charles J. Prescott

(57) ABSTRACT

A lift system for raising and lowering a load including a rigid platform, four spaced fixed supports positioned around corners of the platform, and a power source connected to a first of the supports. First and second inextensible lines are each preferably fastened at one end to a third support diagonally opposing the first support, and at another end thereof to the power source. The first line preferably extends from the power source to the third support, passing to a plurality of four pulleys each attached to a corner of the platform and over a pulley attached to the second support. The second line preferably extends from the power source to the third support, passing to a plurality of four pulleys each attached to a corner of the platform and over a pulley attached to the fourth support. The lift system produces a mechanical advantage of four.

9 Claims, 5 Drawing Sheets

STABILIZED SINGLE-MOTOR LIFT SYSTEM WITHOUT TOP RAILS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the field of lifts and more particularly hoists and suspension systems based on pulleys and cables that are stabilized against tilting and rolling, such as those for lifting, suspending and lowering watercraft.

2. Description of Related Art

Mechanisms for lifting and lowering large loads based on pulleys and cables are especially useful because they are light, strong, and adaptable to many loads and easily powered by one or more motors or a manually driven winch. The alternatives to cables and pulleys usually involve hydraulics, levers, guide channels, screws or other complex mechanisms that add to the cost and complexity and reduce the reliability.

Lifts that remove and replace recreational power vessels and sailing vessels have special requirements. They need to be adaptable to a range of vessels, often over fifty feet in length and up to 50,000 or 70,000 pounds in weight. Simplicity of design, low cost and economy of maintenance are paramount. Moreover, for watercraft it is often inconvenient or practically impossible to provide for cables or structural members that pass overhead across the vessel.

In addition, it is necessary in most applications to lift and lower the load without allowing it to rotate about a horizontal axis. For vessel loads, this is equivalent to the requirement that the vessel be stable against forces that would produce roll or pitch. Stability is usually achieved by employing separate cable lines at the four corners of a rectangular lift mechanism, each separately powered, or powered in pairs from two electrical motors attached to long cylindrical pipes extending along the length of the vessel on either side.

The four-motor lift leaves access to the vessel unobstructed, because each one of the motors may be mounted on one of four posts, which are separated fore-aft and starboard-port so that they do not seriously impede access to the vessel. It has the obvious disadvantage of requiring more than the minimum number of motors. The two-motor lift, on the other hand, has two top rails, or beams, and two parallel pipes to transmit power fore-aft. The attendant top rails not only add to the cost of the lift but they also impede access to the vessel for repair, cleaning, loading and boarding. Moreover, the location of one of the electrical motors outboard of the dock presents additional problems of servicing a motor without dock access (unless additional dockage is provided) and maintaining electrical power cables under water.

In view of the foregoing, it is evident that a need exists for a simple mechanism, based only on cables and pulleys, that lifts and lowers large loads without rotation, and without the use of cables or structural members that pass over the load, with a single electrical motor, located on the dockside, and without rails or other members that impede access to the vessel. Several patents have attempted to address these needs.

U.S. Pat. No. 4,401,335, Golbersen, is directed to a boat hoist including a lift suspension system which results in even application of forces to points on the moveable platform remote from the point of attachment of the lifting device, thus eliminating twisting of the loaded platform.

This patent achieves equal loading of lift points by means of a cable arrangement similar to that of U.S. Pat. No. 5,427,471, which requires that one end of each of two cables be fixed below the surface of the water, and suffers from that same disadvantage.

U.S. Pat. No. 5,090,841, Penick, Jr. et al., is directed to a boat lift in which a hydraulic pump and cylinder with a piston is mounted on a manual boat lift such that the piston rod carries a pulley which engages the lifting cable so that when the piston moves in the cylinder the boat will move up or down.

This patent requires that part of the cable be immersed in the water while the boat is in the lifted position, which has the same disadvantages as U.S. Pat. No. 5,427,471. Moreover the invention calls for a piston and cylinder in addition to lines and pulleys, considerably adding to the maintenance costs of the system.

U.S. Pat. No. 5,427,471, Golbersen, is directed to a boat lift, including a vertical main post mounted on dock with the lower end mounted in the water but spaced above the floor of the water. A frame includes an outer guide post having a platform mounted on the water floor with an upper end above the water level; the frame is connected by a single member to the main post. A platform unit for supporting a small boat is slidably connected at both ends to the main post and the guide post, and a cable and winch unit is interconnected among the foregoing elements for effecting a level lifting and lowering of the platform unit into and out of the water.

This patent suffers from the defect that it requires one end of the cable to be secured at the bottom of the main post, at which point it is continually immersed in the water. This requires frequent replacement of the cable, or the use of a non-corrosive cable material, which adds considerably to the cost of installation and maintenance. Also, because of the restricted size of the vessels that can be lifted by this device, use on large multi-hull vessels is impractical.

U.S. Pat. No. 5,769,568, Parkins et al., is typical of current designs. It consists of two motors, two top rails and four winders operating in a configuration as previously described. It has all the disadvantages of currently employed lifts, namely more than one motor and two top rails.

U.S. Pat. No. 5,772,360, Wood II, has two motors, no top rail and two beams passing under the load. The dockside and water side of each beam are raised and lowered by separate cables, each wound on spools driven by the motor on the dockside pile. These two lines have mechanical advantages of one and three, the different mechanical advantages being compensated for by differential drives on the motor. This arrangement has no top rails and two motors on the dockside, but requires a differential gearing system.

U.S. Pat. No. 5,957,623, Sargent et al., has no top rail and no motor. It consists of a nut on a threaded vertical shaft which nut is rotated to raise or lower a boat attached to the nut.

U.S. Pat. No. 6,470,816, Golden et al., in a four post/dual motor embodiment, raises and lowers the vessel on two beams, one fore and one aft of the vessel, using two motors on the dock side and no top beam. This invention, however suffers from the fact that it is not stable to roll. Further, it requires that the cables be permanently secured below the water, which greatly shortens their life.

U.S. Pat. No. 6,408,776, McLaughlin et al., and U.S. Pat. No. 6,640,736, McLaughlin et al., consists of two beams under the vessel in the shape of a "V." The lift is powered by a single motor at the top of the dockside post, spooling two lines that are each reeved through pulleys to a waterside post with a mechanical advantage of three, and also spooling two other lines each connected to the dockside of one of the beams with a mechanical advantage of one. The two different mechanical advantages are offset by drums of different diameters. The two beams and the vessel are raised or lowered synchronously depending on the direction of rotation of the motor.

These patents have no top rail and only a single dockside motor. The stability of the lift, however, is limited by the "V" shape of the beams, since it presents an asymmetrical support for the vessel. Further, many vessels are heavier at the stern and must be supported there. The lift is unsuitable for catamarans, which must be supported at four symmetrically located coplanar points. Finally, the inventions require two different diameter winches, which adds to the cost and complexity.

An earlier version of these inventions, U.S. Pat. No. 6,230,639, McLaughlin et al., employed two separate waterside posts. In this earlier version, the stability problem is solved, but as in the case of the 2002 and 2003 patents, the cost and complexity of the lift is increased by the use of two winders of different diameters.

U.S. Pat. No. 6,484,655, Gibson, has one motor and no top rail. It has two beams in a "V" formation, similar to other three-piling lifts. It is subject to the limitation of the other three-piling lifts and in addition it is unstable to rolling.

U.S. Pat. No. 7,070,171, Mangin, is directed to a suspension and hoisting system including two cable circuits, each including a cable fixed at one end and attached to a lifting apparatus, such as a winch, at the other, and being reeved around deflection pulleys mounted on two parallel shafts located at either end of the load support, and with the lifting apparatus of each cable being mounted above the load support on the side of the load that is opposite its fixed end. The cable of at least one of the cable circuits is reeved successively around at least two coaxial deflection pulleys mounted on each end shaft in such a way that on at least one of the shafts at least one pulley of one cable circuit rotates in the same direction as at least one pulley of the other cable circuit under identical lifting and lowering action of the two lifting apparatus, while these two pulleys are constrained to rotate in opposite directions by any downwardly oriented force independent of the action of the lifting apparatus. Accordingly, these two pulleys are interlocked to reduce or eliminate any tendency of the load support to incline under the effect of this downward force.

This patent suffers from reliance on friction between cable and pulley to prevent the downward force from lowering one end of the load. In many applications, maintaining a friction-free contact between pulley and cable is difficult because of the presence of water, grease, and dirt on the cables. Moreover, the two cable circuits are of unequal length, which results in unequal elongation under temperature variations, which will tend to make one or the other cable prone to slipping.

U.S. Pat. No. 7,117,805, Shakelford, Jr., is typical of current designs. It consists of two motors, two top rails and four winders operating in a configuration as previously described. This invention has the disadvantages of other current state-of-the art boat lifts, namely it requires two motors, one of which is on the waterside of the vessel, and it requires a top rail on either side of the vessel, both of which obstruct access to the vessel.

U.S. Pat. No. 7,383,781, Griffin, is typical of current designs. It consists of two motors, two top rails and four winders operating in a configuration as previously described. It has the disadvantages of requiring a top rail and having more than one motor.

U.S. Pat. No. 7,407,150, Bellantoni, provides a means of lifting of boats and large loads, by means of cables and pulleys alone and without submerged cables. It is stabilized against rotation by the arrangement of the pulleys and lines. It allows construction of a boat lift with only one motor, but requires two top rails along the length of the vessel, which impede access to the vessel.

U.S. Pat. No. 7,607,644, Gibb et al., has one top beam and no motors. It is limited to boats of 5,000 pounds or less because it is manually powered.

All the above patents provide for raising and lowering of a large load without cables or structural members passing over the load, but either allow rotation of the load, or have top rails along the side of the load impeding access, or require more than one motor, or have one or more substantive disadvantages such as requiring mechanisms more complex than a pulley and cable system, or restricting the location and type of pulleys and cable fastenings, or depending upon frictional resistance to prevent rotation of the load, or being limited in the weight that they can lift, or otherwise requiring that the parts of the cable and one or more pulleys to be permanently submerged. Current commercially available boat lifts, although stable against rotations, usually have two motors and two top rails to carry power to four lifting points.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a lift system for raising and lowering a load including a rigid platform, four spaced fixed supports positioned around corners of the platform, and a power source connected to a first of the supports. First and second inextensible lines are each preferably fastened at one end to a third support diagonally opposing the first support, and at another end thereof to the power source. The first line preferably extends from the power source to the third support, passing to a plurality of four pulleys each attached to a corner of the platform and over a pulley attached to the second support. The second line preferably extends from the power source to the third support, passing to a plurality of four pulleys each attached to a corner of the platform and over a pulley attached to the fourth support. The lift system produces a mechanical advantage of four.

In this invention, the load is raised or lowered by a single power source operating through pulleys and cables and without lines or beams passing over the load and without a top rail along either side of the vessel and with only one power source, which power source is located on the dockside of the vessel, or at any of the four supporting posts for non-vessel loads. This invention provides a self-stabilized horizontal platform when the load is supported at four co-planar points, such as is provided by a catamaran or by a planar load. Thus this invention provides a stabilized lift, unobstructed by rails, suitable for large and multi-hull vessels, using only pulleys, cables, beams and a single dockside power source.

The present invention includes a cable and pulley system to raise or lower a large load such as a vessel, supported on a rigid platform, which platform is beneath and supporting the load or vessel. This rigid platform and the load thereon are suspended by cables and pulleys from four fixed supports, such as posts or piles. The assembly is raised or lowered by a single power source. The components of the invention comprise:

(1) four posts or other rigid supports, comprising two fixed supports fore and two fixed supports aft on either side of the load or vessel;

(2) a planar platform, rigid against bending and torsion, underneath and supporting the load, one end of which is located between the two forward supports and the other end of which is located between the two aft supports;

(3) a single power source secured to one of the fixed supports;

(4) ten pulleys, of which eight are fixed to the rigid platform and two are fixed on separate posts, located as described below;

(5) two inextensible lines connecting the supports, the platform, and the power source via the pulleys in the manner described below, which lines are drawn up or let out at the same rate by the power source to raise or lower the load.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 2:
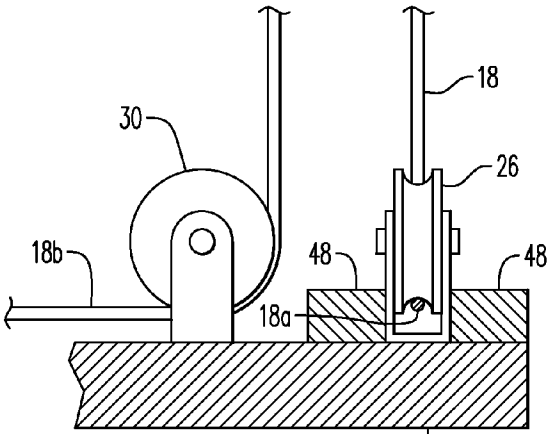
FIG. 2 is a section view in the direction of arrows 2-2 in FIG. 1.

Exemplary embodiments are illustrated in reference figures of the drawings. It is intended that the embodiments and figures disclosed herein are to be considered to be illustrative rather than limiting.

DETAILED DESCRIPTION OF THE INVENTION

The invention may be understood from the following detailed description taken in conjunction with the accompanying figures, in which like reference numerals identify like elements.

Figure 1:
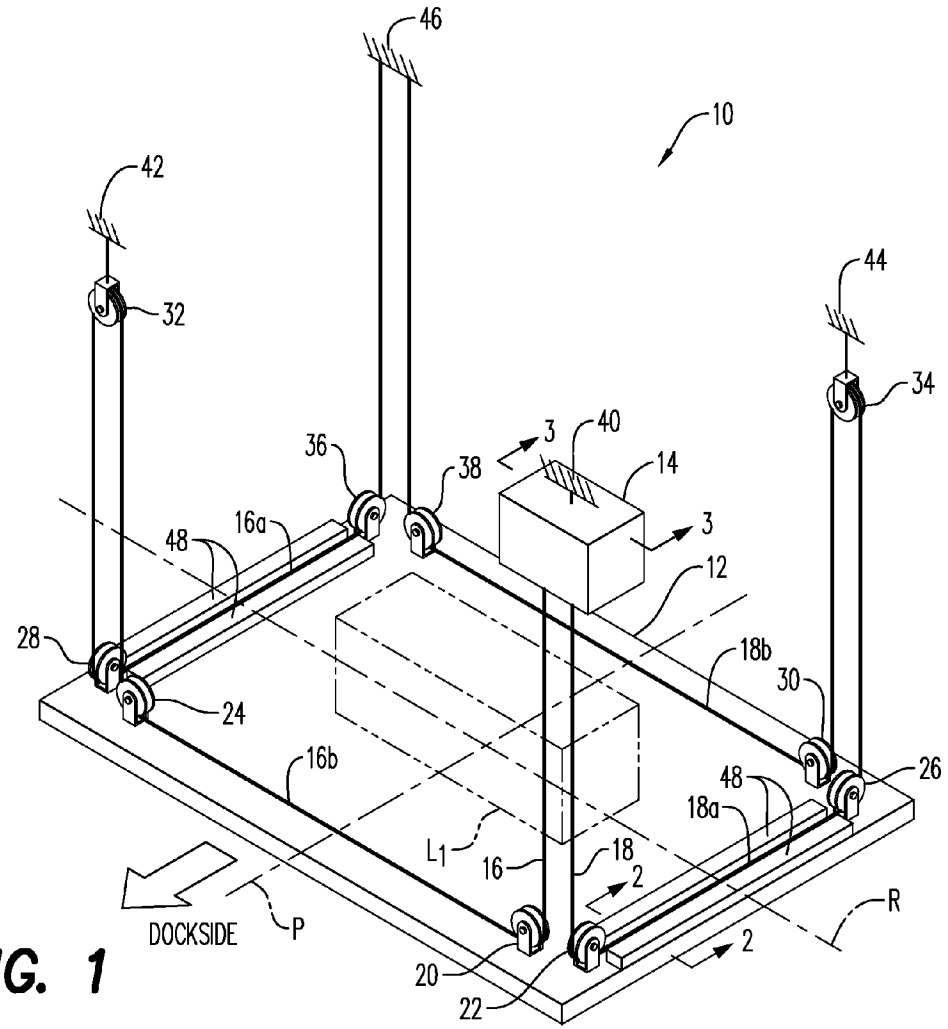
FIG. 1 is a perspective view of one embodiment of the invention showing an elongated load (in phantom) atop the platform.

FIG. 1 illustrates a first embodiment of a pulley system shown generally at numeral 10 constructed in accordance with the teachings of the present invention. The system 10 includes four fixed supports 40, 42, 44 and 46 such as posts or pilings and two non-extensible flexible lines or cables 16 and 18 supporting a weight load L1 on a rigid platform 12 via ten pulleys 20, 22, 24, 26, 28, 30, 32, 34, 36 and 38, five on each line 16 and 18. Four pulleys 20, 24, 28, 36/22, 26, 30, 38 on each line 16/18, respectively, are attached to the rigid platform 12 and one pulley 32/34 on each line 16/18 is attached to one of the four fixed supports 42/44. Further, one end of each line 16 and 18 is attached to fixed support 46, while the other end of each line 16 and 18 is drawn by a motor 14, manual windlass or other power source attached to fixed support 40. These lines 16 and 18 are non-extendable lines or cables. When drawn at the same rate, they will lift the load L1 without allowing the platform 12 to rotate about either horizontal axis R or P.

The pulley system 10 includes first fixed support 40, second fixed support 42, third fixed support 44, and fourth fixed support 46, all of which cooperatively support the pulley system 10. The first fixed support 40 supports power source 14, best seen in FIG. 3, which retracts and extends the first line 16 and the second line 18 at the same rate on equally sized spools 50 and 52 by a motor/gearbox, manual windlass or other power source.

The first line 16 passes down from the power source 14 and under pulley 20 which is connected atop the rigid platform 12, and then along the length of platform 12 at 16*b* and under pulley 24 which is also connected atop the platform 12. The first line 16 extends up and over the pulley 32 which is connected to fixed support 42, and then down to pulley 28 attached atop platform 12. Line 16 then passes across the width of the platform 12 at 16*a* to pulley 36, which is attached atop platform 12, and the up to fixed support 46, where it terminates and is fastened.

The second line 18 is also connected to the power source 14, passing down to pulley 22 which is rigidly connected atop platform 12. The second line 18 then passes across the width of platform 12 at 18*a* to pulley 26 which is connected atop the platform 12 and up to pulley 34 which is attached to fixed support 44. Line 18 then is reeved through pulley 34 and back down to pulley 30, which is attached atop platform 12, and then along the length of platform 12 at 18*b* to and under the pulley 38 which is also connected atop platform 12, then passing up to fixed support 46, where it terminates and is fastened.

Note the alternate form of pulley attachment to the platform 12 in FIG. 2 where any interference between the line portions 16*a* and 18*a* is avoided by spaced elongated strips 48 attached atop the platform 12.

The load L1 is carried by platform 12. Axis R extends in the longitudinal direction of the load L1 and axis P extends perpendicular to axis R in the plane of the platform 12. Thus, the pair of lines 16 and 18, each attached at one end thereof to the power source 14 and to the fixed support 46 at the other ends thereof, and reeved through the ten pulleys as shown in FIG. 1 and drawn at the same rate by the power sources 14, will lift a rigid planar load, such as indicated by Load L1, without significant rotation about either the axis R along the length of the load L1 or about the axis P perpendicular to the length of the load L1, which is verified by the analysis immediately following.

Analysis of the Invention

Figure 3:
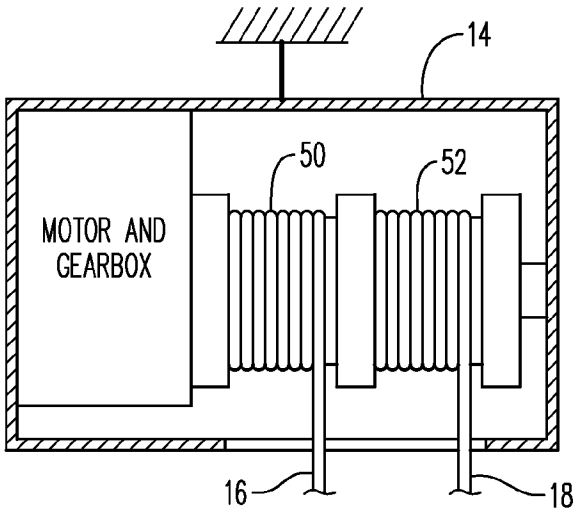
FIG. 3 is a section view in the direction of arrows 3-3 in FIG. 1.

Referring still to the pulley system of FIGS. 1 and 3, Load L1 is lifted or lowered when the power source 14 is activated, and the inextensible lines 16 and 18 are evenly drawn into or let out of the power source 14 as seen in FIG. 3. Considering the conditions when the power source is inactivated, let:

$H_1$=height from pulley 22 to Power Source 14=height from pulley 20 to Power Source 14

$H_2$=height from pulley 24 to pulley 32=height from pulley 28 to pulley 32

$H_3$=height from pulley 36 to Fixed Support 46=height from pulley 38 to Fixed Support 46

$H_4$=height from pulley 30 to pulley 34=height from pulley 26 to pulley 34

W=base width=distance from pulley 22 to pulley 26=distance from pulley 28 to pulley 36

L=base length=distance from pulley 20 to pulley 24=distance from pulley 38 to pulley 30

The first line 16 has length $L_1$, measured from the power source 14 to the point at which it is fastened to the support 46 where:

$$L_1=H_1+L+2*H_2+W+H_3+K_1, \quad (1)$$

and the second line 18 has the length $L_2$, similarly measured, where:

$$L_2=H_1+W+2*H_4+L+H_3+K_2, \quad (2)$$

where K1 and K2 are constants representing the remainder of each line. Small changes $\delta H_1$, $\delta H_2$, $\delta H_3$, $\delta H_4$ in the heights $H_1$, $H_2$, $H_3$, $H_4$ produce small changes $\delta L_1$ and $\delta L_2$ in the line lengths $L_1$ and $L_2$:

$$\delta L_1=\delta H_1+2*\delta H_2+\delta H_3 \quad (3)$$

$$\delta L_2=\delta H_1+2*\delta H_4+\delta H_3. \quad (4)$$

Because the two lines 16 and 18 have equal length, and because they are drawn in and out of the power source 14 equally, it follows that $L_1=L_2$. Because the two lines are inextensible, it follows that when the power source 14 is inactive $\delta L_1=\delta L_2=0$. This gives the conditions:

$$\delta H_1+\delta H_3=-2*\delta H_2 \quad \text{(Condition 1)}$$

$$\delta H_2=\delta H_4 \quad \text{(Condition 2)}$$

Further, it can be shown that, if the platform 12 maintains the relative positions of all pulleys attached to it, i.e., if the platform is perfectly rigid, then $\delta H_1=\delta H_2=\delta H_3=\delta H_4$. When combined with Condition 1 and Condition 2, it follows that:

$$\delta H_1=\delta H_2=\delta H_3=\delta H_4=0,$$

which indicates that the platform 12 will not rotate in the above configuration if the lines 16 and 18 are inextensible and have no slack and if the platform 12 is perfectly rigid.

Therefore a boat lift configured as described in this invention as shown in FIG. 1 has several advantages over the conventional top rail boat lift:

(1) The boat lift is powered by one motor instead of two.

(2) The single motor may be located on the dock side of the lift, facilitating installation and maintenance.

(3) The two top rails and powered pipes along the length of the vessel in conventional lifts are eliminated, facilitating boarding, maintenance and loading, and reducing cost.

(4) The four winding drums of conventional lifts are replaced by two winding drums.

(5) The vessel is automatically stabilized against roll and pitch while being lifted, suspended and lowered.

Alternate Forms of the Invention

Figure 4:
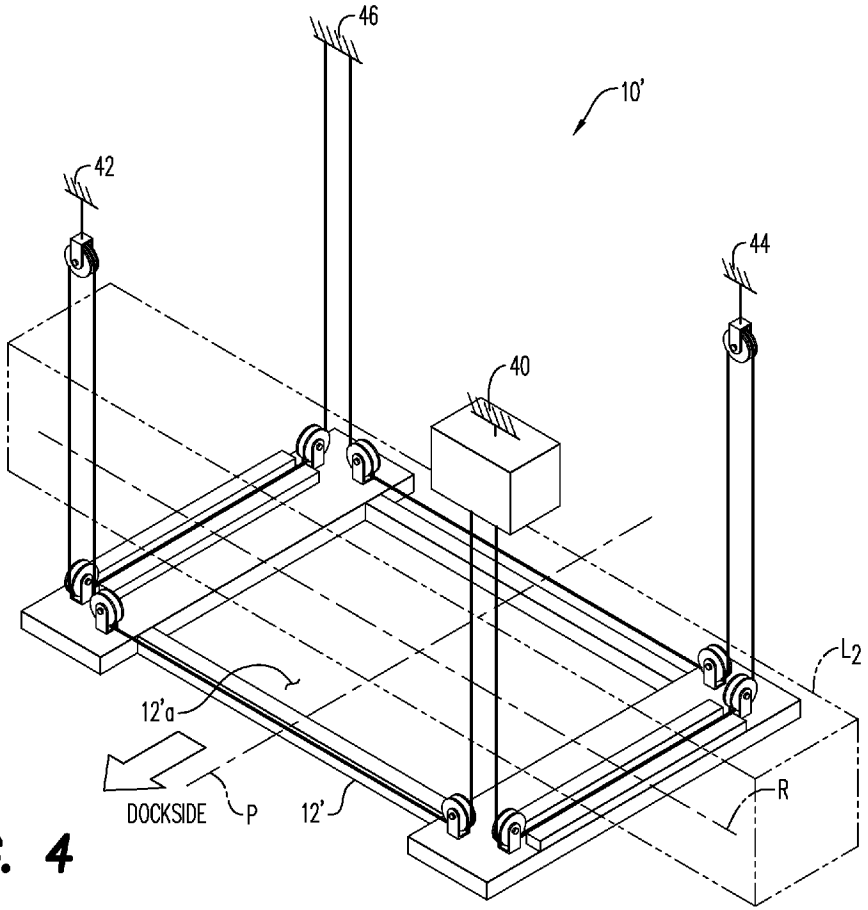
FIG. 4 is a perspective view of a second embodiment of the invention showing an elongated load (in phantom) carried atop the platform.

Referring now to FIG. 4, a first alternate embodiment of the invention is there shown generally at numeral 10' incorporating an open platform 12' wherein the open section 12'*a* substantially reduces the overall weight and cost thereof. Any loss in torsional stiffness and rigidity is compensated for by an enlarged rigid load L2 such as is presented by a multi-hull vessel such as a catamaran which adds substantial twisting rigidity to the lightened open platform 12'. Otherwise, this embodiment 10' is substantially as shown and described with respect to FIG. 1.

Figure 6:
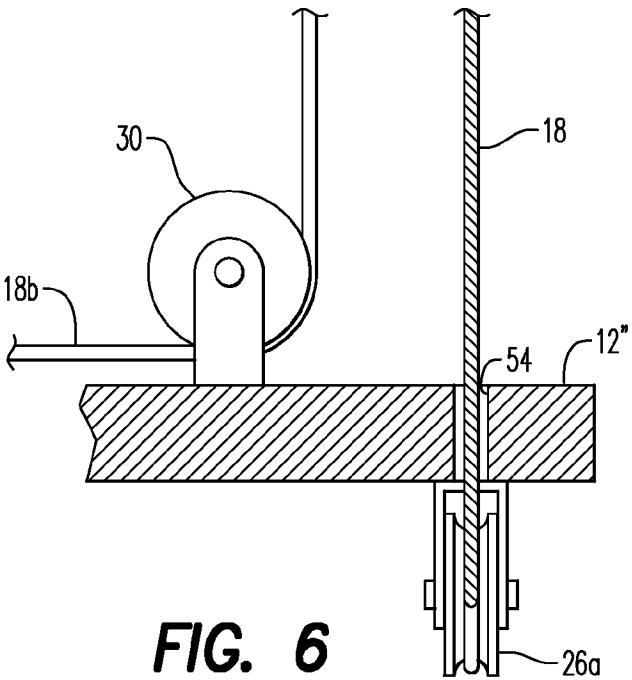
FIG. 6 is a section view in the direction of arrows 6-6 in FIG. 5.
Figure 5:
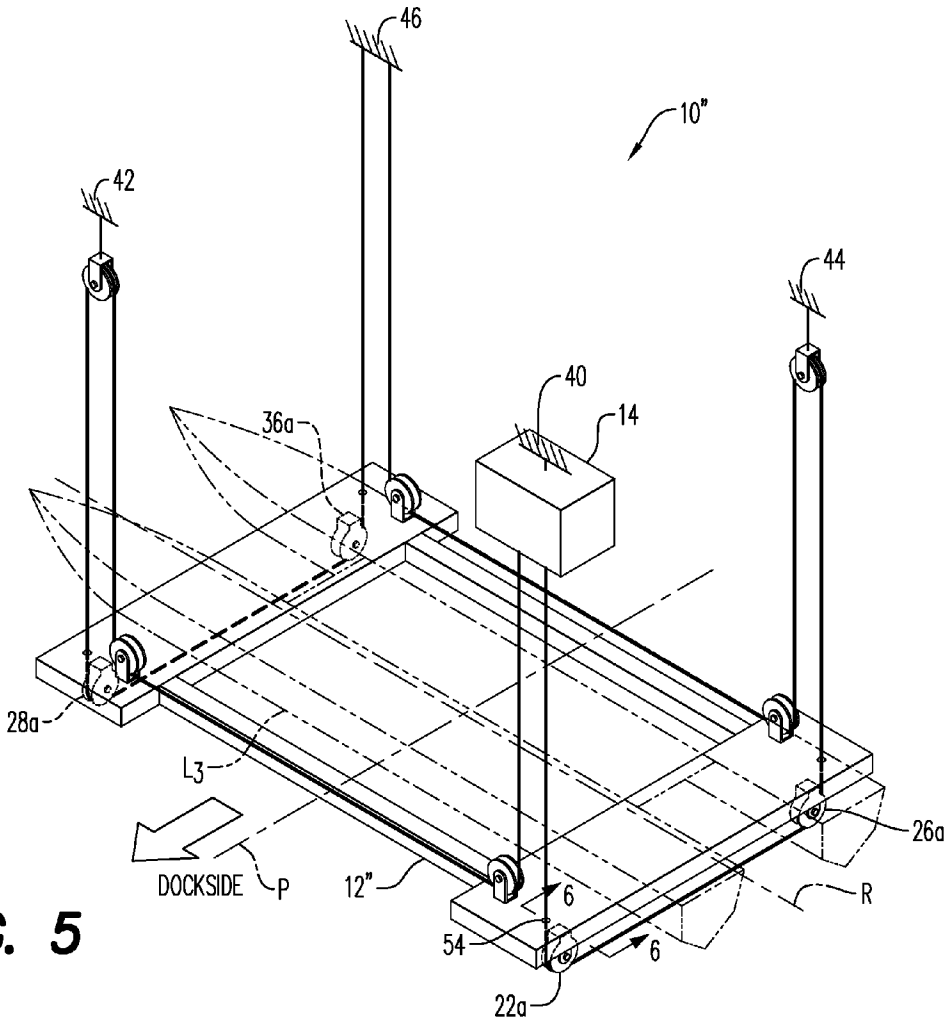
FIG. 5 is a perspective view of a third embodiment of the invention depicting a catamaran (in phantom) carried atop the platform.

Referring now to FIGS. 5 and 6, a second alternate embodiment of the invention is there shown generally at numeral 10" wherein all of the structural features of this embodiment 10' are as described in FIG. 4 except with respect to pulleys 22*a*, 26*a*, 28*a*, and 36*a* which, as seen in FIG. 6, are positioned beneath and against the lower surface of platform 12" wherein clearance holes 54 are formed through the platform 12" for the line 18 (and 16) to pass therethrough. It is noted that the load L3 in the form of a catamaran hull adds sufficient rigidity to the open platform 12" as described in FIG. 4 so as to avoid any twisting components to distort the flatness of platform 12'.

Generalization of the Invention

In addition to the configuration of lines and pulleys shown in FIGS. 1, 4 and 5, several arrangements may be devised so as to produce a single-motor lift that has no top rails and is stable against lifting platform rotations. A delineation of all possible arrangements of two lines, each of mechanical advantage of four, attached to a single motor on post #1, and routed to at least one of four posts #1, #2, #3 and #4 placed in counterclockwise order at the four corners of the platform carrying a load, and in which the two lines have different routings, shows that there are 120 distinct routings. Because they represent only two inextensible lines, these line arrangements in themselves are not stable against platform rotations. When attached to a rigid platform, however, exactly 95 of the configurations are stable to rotation. These 95 configurations are shown in Table 2 below, the derivation of which follows:

There are 16 distinct ways that a line may be routed from a power source such as a spool or winch on post #1 (referenced in FIG. 7) to a fastening on one of the four posts if the mechanical advantage is maintained at four. They are listed in Table 1 below.

TABLE 1

Mechanical Advantages (MA) of a Line at Each of Four Supporting Posts for 16 Possible Routings of The Line Starting at Post #1

| Routing Number | Post #1 | Post #2 | Post #3 | Post #4 |
|---|---|---|---|---|
| 01 | 1 | 2 | 1 | 0 |
| 02 | 1 | 2 | 0 | 1 |
| 03 | 1 | 1 | 2 | 0 |
| 04 | 1 | 0 | 2 | 1 |
| 05 | 1 | 1 | 0 | 2 |
| 06 | 1 | 0 | 1 | 2 |
| 07 | 1 | 3 | 0 | 0 |
| 08 | 1 | 0 | 3 | 0 |
| 09 | 1 | 0 | 0 | 3 |
| 10 | 2 | 2 | 0 | 0 |
| 11 | 2 | 0 | 2 | 0 |
| 12 | 2 | 0 | 0 | 2 |
| 13 | 3 | 1 | 0 | 0 |
| 14 | 3 | 0 | 1 | 0 |
| 15 | 3 | 0 | 0 | 1 |
| 16 | 4 | 0 | 0 | 0 |

Figure 7:
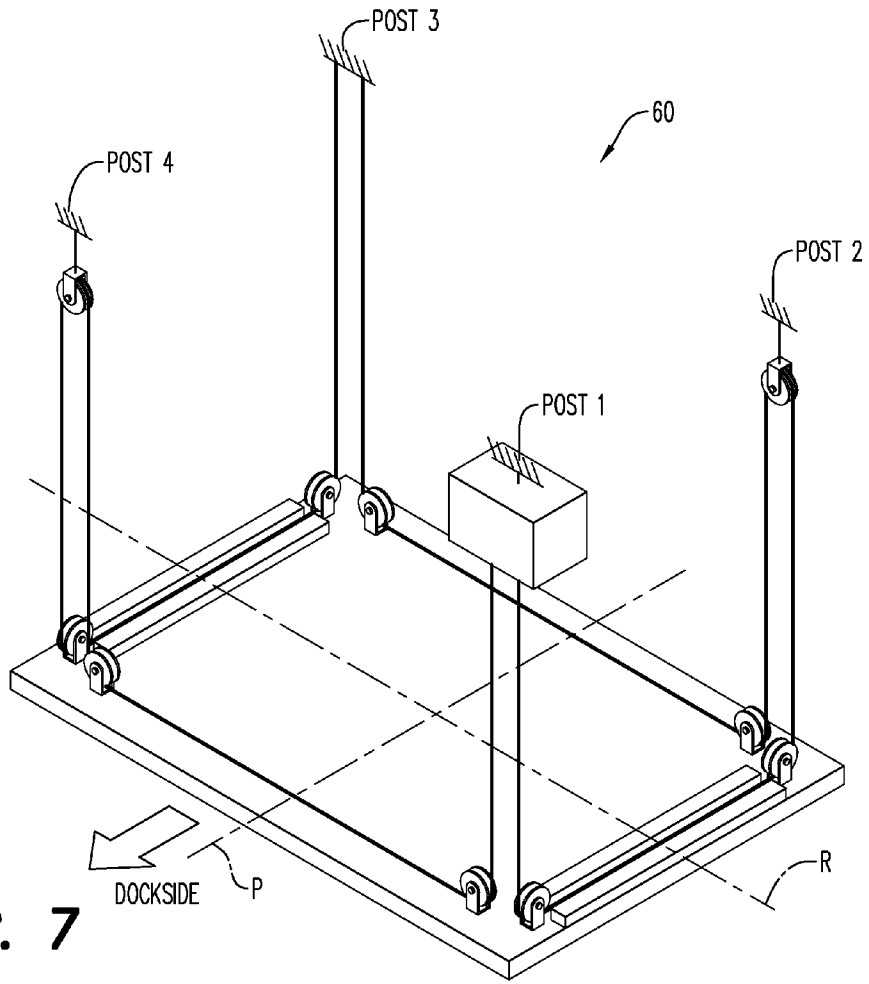
FIG. 7 is a perspective view of the preferred arrangement of posts and pulleys as described in Table 2, Configuration #5.

In Table 1, the routing of each line is represented by a row of four numbers, which numbers give the mechanical advantage (MA) of that line at each of the four lift posts. The posts are taken in order from the right post #1 going around the load counterclockwise and ending at the left post #4 as shown in FIG. 7. The sum of the numbers in each row is four, representing the total mechanical advantage of each line. The entries in a row are interpreted as follows:

A MA of 1 indicates that the line goes down from the spool (on post #1) or down from a fastening (on posts #2, #3, #4), through a pulley on the platform and thence to another post.

A MA of 2 in column 1, indicates that one end of the line is spooled at the top of the post #1 and passes down through a pulley on the platform at post #1 to another post and that the other end of the line returns from the other post, passes through a second pulley on the platform at post #1 and thence up to the top of the post #1 where it is fastened.

A MA of 2 not in column 1 indicates that the line goes through a pulley on the platform at the post corresponding to the column, up through a pulley at the top of that post and back down through another pulley on the platform at the post corresponding to the column, to a different post.

A MA of 3 indicates that the line goes from a spool or fastening at the top of the post through a pulley at the platform, then back up through a second pulley at the top of the post and back down through a third pulley on the platform to a different post.

A MA of 4 indicates that the line goes from the spool at the top of the post to a pulley at the platform, up through a second pulley at the top of the post, back down through a third pulley at the platform and back up to the top of the post, where it is fastened.

Table 2 below shows 95 configurations, identified as #1, #2, . . . , #95, each representing a possible routing of the two cables. Each configuration is obtained by selecting two different rows from Table 1. The two rows are identified by their Row numbers shown under the Configuration number in Table 2, followed by the rows of MAs. The third row of numbers in the matrix shows for each post the sum of the mechanical advantages (MAs) of the two lines at the post, which is equal to the relative load on the post.

TABLE 2

Ninety-Five Stable Configurations of Two Lines Attached to a Motor on Post #1 and Routed Among Four Posts So That Each Has a Mechanical Advantage Of Four.

| | | | | |
|---|---|---|---|---|
| #1<br>Rows 01 02<br>1 2 1 0<br>1 2 0 1 | #2<br>Rows 01 03<br>1 2 1 0<br>1 1 2 0 | #3<br>Rows 01 04<br>1 2 1 0<br>1 0 2 1 | #4<br>Rows 01 05<br>1 2 1 0<br>1 1 0 2 | #5<br>Rows 01 06<br>1 2 1 0<br>1 0 1 2 |
| 2 4 1 1 | 2 3 3 0 | 2 2 3 1 | 2 3 1 2 | 2 2 2 2 |
| #6<br>Rows 01 07<br>1 2 1 0<br>1 3 0 0 | #7<br>Rows 01 08<br>1 2 1 0<br>1 0 3 0 | #8<br>Rows 01 09<br>1 2 1 0<br>1 0 0 3 | #9<br>Rows 01 10<br>1 2 1 0<br>2 2 0 0 | #10<br>Rows 01 11<br>1 2 1 0<br>2 0 2 0 |
| 2 5 1 0 | 2 2 4 0 | 2 2 1 3 | 3 4 1 0 | 3 2 3 0 |
| #11<br>Rows 01 12<br>1 2 1 0<br>2 0 0 2 | #12<br>Rows 01 13<br>1 2 1 0<br>3 1 0 0 | #13<br>Rows 01 14<br>1 2 1 0<br>3 0 1 0 | #14<br>Rows 01 15<br>1 2 1 0<br>3 0 0 1 | #15<br>Rows 02 03<br>1 2 0 1<br>1 1 2 0 |
| 3 2 1 2 | 4 3 1 0 | 4 2 2 0 | 4 2 1 1 | 2 3 2 1 |
| #16<br>Rows 02 04<br>1 2 0 1<br>1 0 2 1 | #17<br>Rows 02 05<br>1 2 0 1<br>1 1 0 2 | #18<br>Rows 02 06<br>1 2 0 1<br>1 0 1 2 | #19<br>Rows 02 07<br>1 2 0 1<br>1 3 0 0 | #20<br>Rows 02 08<br>1 2 0 1<br>1 0 3 0 |

TABLE 2-continued

Ninety-Five Stable Configurations of Two Lines Attached to a Motor on Post #1 and Routed Among Four Posts So That Each Has a Mechanical Advantage Of Four.

| | | | | |
|---|---|---|---|---|
| 2 2 2 2 | 2 3 0 3 | 2 2 1 3 | 2 5 0 1 | 2 2 3 1 |
| #21<br>Rows 02 09<br>1 2 0 1<br>1 0 0 3 | #22<br>Rows 02 10<br>1 2 0 1<br>2 2 0 0 | #23<br>Rows 02 11<br>1 2 0 1<br>2 0 2 0 | #24<br>Rows 02 12<br>1 2 0 1<br>2 0 0 2 | #25<br>Rows 02 13<br>1 2 0 1<br>3 1 0 0 |
| 2 2 0 4 | 3 4 0 1 | 3 2 2 1 | 3 2 0 3 | 4 3 0 1 |
| #26<br>Rows 02 14<br>1 2 0 1<br>3 0 1 0 | #27<br>Rows 02 15<br>1 2 0 1<br>3 0 0 1 | #28<br>Rows 03 04<br>1 1 2 0<br>1 0 2 1 | #29<br>Rows 03 05<br>1 1 2 0<br>1 1 0 2 | #30<br>Rows 03 06<br>1 1 2 0<br>1 0 1 2 |
| 4 2 1 1 | 4 2 0 2 | 2 1 4 1 | 2 2 2 2 | 2 1 3 2 |
| #31<br>Rows 03 07<br>1 1 2 0<br>1 3 0 0 | #32<br>Rows 03 08<br>1 1 2 0<br>1 0 3 0 | #33<br>Rows 03 09<br>1 1 2 0<br>1 0 0 3 | #34<br>Rows 03 10<br>1 1 2 0<br>2 2 0 0 | #35<br>Rows 03 11<br>1 1 2 0<br>2 0 2 0 |
| 2 4 2 0 | 2 1 5 0 | 2 1 2 3 | 3 3 2 0 | 3 1 4 0 |
| #36<br>Rows 03 12<br>1 1 2 0<br>2 0 0 2 | #37<br>Rows 03 13<br>1 1 2 0<br>3 1 0 0 | #38<br>Rows 03 14<br>1 1 2 0<br>3 0 1 0 | #39<br>Rows 03 15<br>1 1 2 0<br>3 0 0 1 | #40<br>Rows 04 05<br>1 0 2 1<br>1 1 0 2 |
| 3 1 2 2 | 4 2 2 0 | 4 1 3 0 | 4 1 2 1 | 2 1 2 3 |
| #41<br>Rows 04 06<br>1 0 2 1<br>1 0 1 2 | #42<br>Rows 04 07<br>1 0 2 1<br>1 3 0 0 | #43<br>Rows 04 08<br>1 0 2 1<br>1 0 3 0 | #44<br>Rows 04 09<br>1 0 2 1<br>1 0 0 3 | #45<br>Rows 04 10<br>1 0 2 1<br>2 2 0 0 |
| 2 0 3 3 | 2 3 2 1 | 2 0 5 1 | 2 0 2 4 | 3 2 2 1 |
| #46<br>Rows 04 11<br>1 0 2 1<br>2 0 2 0 | #47<br>Rows 04 12<br>1 0 2 1<br>2 0 0 2 | #48<br>Rows 04 13<br>1 0 2 1<br>3 1 0 0 | #49<br>Rows 04 14<br>1 0 2 1<br>3 0 1 0 | #50<br>Rows 04 15<br>1 0 2 1<br>3 0 0 1 |
| 3 0 4 1 | 3 0 2 3 | 4 1 2 1 | 4 0 3 1 | 4 0 2 2 |
| #51<br>Rows 05 06<br>1 1 0 2<br>1 0 1 2 | #52<br>Rows 05 07<br>1 1 0 2<br>1 3 0 0 | #53<br>Rows 05 08<br>1 1 0 2<br>1 0 3 0 | #54<br>Rows 05 09<br>1 1 0 2<br>1 0 0 3 | #55<br>Rows 05 10<br>1 1 0 2<br>2 2 0 0 |
| 2 1 1 4 | 2 4 0 2 | 2 1 3 2 | 2 1 0 5 | 3 3 0 2 |
| #56<br>Rows 05 11<br>1 1 0 2<br>2 0 2 0 | #57<br>Rows 05 12<br>1 1 0 2<br>2 0 0 2 | #58<br>Rows 05 13<br>1 1 0 2<br>3 1 0 0 | #59<br>Rows 05 14<br>1 1 0 2<br>3 0 1 0 | #60<br>Rows 05 15<br>1 1 0 2<br>3 0 0 1 |
| 3 1 2 2 | 3 1 0 4 | 4 2 0 2 | 4 1 1 2 | 4 1 0 3 |
| #61<br>Rows 06 07<br>1 0 1 2<br>1 3 0 0 | #62<br>Rows 06 08<br>1 0 1 2<br>1 0 3 0 | #63<br>Rows 06 09<br>1 0 1 2<br>1 0 0 3 | #64<br>Rows 06 10<br>1 0 1 2<br>2 2 0 0 | #65<br>Rows 06 11<br>1 0 1 2<br>2 0 2 0 |
| 2 3 1 2 | 2 0 4 2 | 2 0 1 5 | 3 2 1 2 | 3 0 3 2 |
| #66<br>Rows 06 12<br>1 0 1 2<br>2 0 0 2 | #67<br>Rows 06 13<br>1 0 1 2<br>3 1 0 0 | #68<br>Rows 06 14<br>1 0 1 2<br>3 0 1 0 | #69<br>Rows 06 15<br>1 0 1 2<br>3 0 0 1 | #70<br>Rows 07 08<br>1 3 0 0<br>1 0 3 0 |
| 3 0 1 4 | 4 1 1 2 | 4 0 2 2 | 4 0 1 3 | 2 3 3 0 |

TABLE 2-continued

Ninety-Five Stable Configurations of Two Lines Attached to a Motor on Post #1 and Routed Among Four Posts So That Each Has a Mechanical Advantage Of Four.

| | | | | |
|---|---|---|---|---|
| #71<br>Rows 07 09<br>1 3 0 0<br>1 0 0 3 | #72<br>Rows 07 11<br>1 3 0 0<br>2 0 2 0 | #73<br>Rows 07 12<br>1 3 0 0<br>2 0 0 2 | #74<br>Rows 07 14<br>1 3 0 0<br>3 0 1 0 | #75<br>Rows 07 15<br>1 3 0 0<br>3 0 0 1 |
| 2 3 0 3 | 3 3 2 0 | 3 3 0 2 | 4 3 1 0 | 4 3 0 1 |
| #76<br>Rows 08 09<br>1 0 3 0<br>1 0 0 3 | #77<br>Rows 08 10<br>1 0 3 0<br>2 2 0 0 | #78<br>Rows 08 12<br>1 0 3 0<br>2 0 0 2 | #79<br>Rows 08 13<br>1 0 3 0<br>3 1 0 0 | #80<br>Rows 08 15<br>1 0 3 0<br>3 0 0 1 |
| 2 0 3 3 | 3 2 3 0 | 3 0 3 2 | 4 1 3 0 | 4 0 3 1 |
| #81<br>Rows 09 10<br>1 0 0 3<br>2 2 0 0 | #82<br>Rows 09 11<br>1 0 0 3<br>2 0 2 0 | #83<br>Rows 09 13<br>1 0 0 3<br>3 1 0 0 | #84<br>Rows 09 14<br>1 0 0 3<br>3 0 1 0 | #85<br>Rows 10 11<br>2 2 0 0<br>2 0 2 0 |
| 3 2 0 3 | 3 0 2 3 | 4 1 0 3 | 4 0 1 3 | 4 2 2 0 |
| #86<br>Rows 10 12<br>2 2 0 0<br>2 0 0 2 | #87<br>Rows 10 14<br>2 2 0 0<br>3 0 1 0 | #88<br>Rows 10 15<br>2 2 0 0<br>3 0 0 1 | #89<br>Rows 11 12<br>2 0 2 0<br>2 0 0 2 | #90<br>Rows 11 13<br>2 0 2 0<br>3 1 0 0 |
| 4 2 0 2 | 5 2 1 0 | 5 2 0 1 | 4 0 2 2 | 5 1 2 0 |
| #91<br>Rows 11 15<br>2 0 2 0<br>3 0 0 1 | #92<br>Rows 12 13<br>2 0 0 2<br>3 1 0 0 | #93<br>Rows 12 14<br>2 0 0 2<br>3 0 1 0 | #94<br>Rows 13 14<br>3 1 0 0<br>3 0 1 0 | #95<br>Rows 13 15<br>3 1 0 0<br>3 0 0 1 |
| 5 0 2 1 | 5 1 0 2 | 5 0 1 2 | 6 1 1 0 | 6 1 0 1 |
| | | #96<br>Rows 14 15<br>3 0 1 0<br>3 0 0 1 | | |
| | | 6 0 1 1 | | |

Key:
Configuration #
Row numbers
First Row
Second Row
Column Sums
120 configurations
96 stable configurations
3 balanced configurations
3 symmetric configurations
22 square configurations Each configuration in Table 2 represents an alternate form of this invention. Only routings that are stable when supporting a rigid platform are shown. All such forms are stable against rotation by virtue of the line configuration and the rigidity of the platform.

Stability is achieved as follows:

The line configuration conditions are represented by Condition 1 and Condition 2 given above. When Conditions 1 and 2 are combined with the rigidity of the platform, there results Condition 3 and Condition 4:

$$\alpha R(r_{13} \text{ and } r_{14})+\beta B(r_{12} \text{ and } r_{13})=0 \quad \text{(Condition 3)}$$

$$\alpha R(r_{23} \text{ and } r_{24})+\beta B(r_{22} \text{ and } r_{23})=0 \quad \text{(Condition 4)}$$

where α and β are the tilts about axes P and R, respectively, shown in FIG. 1 and ij is the ith row and jth column of the configurations shown in Table 2, where i=1, 2 and j=1, 2, 3, 4. The platform is stable against rotations about axes P and R when the matrix of coefficients of α and β has a non-zero determinant.

The primary form of this invention is configuration #5 in Table 2 and is shown in FIG. 7. This configuration is unique in that (1) it presents a uniform MA of 2 at each post, and (2) it does not have any diagonally routed lines. The equal MAs distribute the load uniformly on the four posts, thereby avoiding excessive stress on any one post. The absence of diagonally routed lines avoids diagonal stress on the platform, thus eliminating the need for diagonal bracing.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A lift system for raising and lowering a load comprising:

a substantially rigid platform;

first, second, third and fourth fixed supports spaced apart and positioned around said platform;

a power source connected to said first support;

a first inextensible line fastened at one end to said third support and at another end thereof to said power source, said third support positioned diagonally opposite from said first support;

said first line extending downwardly from said power source and beneath a pulley connected to a first dockside facing corner of said platform, then extending along a dockside edge of said platform and around a pulley connected to a second dockside facing corner of said platform, then extending upward and around a pulley connected to said second support, then downwardly and around another pulley connected to the second dockside facing corner of said platform, said first line then extending across one end of said platform to a pulley connected to a first outer corner of said platform and upward to said third support;

a second line fastened at one end to said third support and, at another end thereof, to said power source;

said second line extending downwardly from said power source to another pulley connected to said first dockside corner of said platform, then extending across another end of said platform to a pulley connected to a second outer corner of said platform, then extending upwardly and around a pulley connected to said fourth support, then downwardly and around another pulley connected to said second outer corner, then extending along an outer edge of said platform and around another pulley connected to said third outer corner and upwardly to said third support;

said first and second lines and corresponding said pulleys each producing a mechanical advantage between said power source and said third support to lift said platform of four.

2. A lift system as set forth in claim 1, wherein:

said platform is rigidized by a load carried atop said platform.

3. A lift system as set forth in claim 1, wherein:

said platform is rigidized by a catamaran-type boat carried atop said platform.

4. A lift system for raising and lowering a load comprising:

a substantially rigid platform;

first, second, third and fourth fixed supports spaced apart and positioned around said platform;

a power source connected to said first support;

a first inextensible line fastened at one end to said third support and at another end thereof to said power source, said third support positioned diagonally opposite from said first support;

said first line extending downwardly from said power source and beneath and over a plurality of four pulleys connected to three corners of said platform and around another pulley connected to said second support;

a second inextensible line fastened at one end to said third support and, at another end thereof, to said power source;

said second line extending downwardly from said power source to and around and beneath another plurality of four pulleys connected to three corners of said platform and around another pulley connected to said fourth support;

said first and second lines and corresponding said pulleys each producing a mechanical advantage between said power source and third said support of four.

5. A lift system as set forth in claim 4, wherein:

said platform is rigidized by a load carried atop said platform.

6. A lift system as set forth in claim 4, wherein:

said platform is rigidized by a catamaran-type boat carried atop said platform.

7. A lift system for raising and lowering a load comprising:

a substantially rigid generally rectangular platform having four corners thereof;

first, second, third and fourth fixed supports each positioned in sequential orientation above one of said corners of said platform;

a power source connected to said first support;

a first inextensible line fastened at one end to said third support and at another end thereof to said power source, said third support positioned diagonally opposite from said first support;

said first line extending downwardly from said power source and beneath a pulley connected to a first corner of said platform, to a pulley connected to a second corner of said platform, then extending upward and around a pulley connected to said second support, then downwardly and around another pulley connected to the second corner of said platform, said first line then extending to a pulley connected to a third corner of said platform and upward to said third support;

a second line fastened at one end to said third support and, at another end thereof, to said power source;

said second line extending downwardly from said power source to a pulley connected to said first corner of said platform, to a pulley connected to a fourth corner of said platform, then upwardly and around a pulley connected to said fourth support, then downwardly and around another pulley connected to said fourth corner, then extending to a pulley connected to said third corner and upward to said third support;

said first and second lines and corresponding said pulleys each producing a mechanical advantage between said power source and third support of four;

a mechanical advantage produced between each of said supports and a corresponding corner of said platform of two.

8. A lift system as set forth in claim 7, wherein:

said platform is rigidized by a load carried atop said platform.

9. A lift system as set forth in claim 7, wherein:

said platform is rigidized by a catamaran-type boat carried atop said platform.

* * * * *